US009850700B2

(12) United States Patent
Sawada

(10) Patent No.: US 9,850,700 B2
(45) Date of Patent: Dec. 26, 2017

(54) WATERPROOFING MEMBER AND EXTERIOR WALL STRUCTURE

(71) Applicant: NICHIHA CORPORATION, Nagoya-shi, Aichi (JP)

(72) Inventor: Yohei Sawada, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days.

(21) Appl. No.: 14/882,974

(22) Filed: Oct. 14, 2015

(65) Prior Publication Data

US 2016/0265270 A1 Sep. 15, 2016

(30) Foreign Application Priority Data

Mar. 12, 2015 (JP) ..... 2015-049037

(51) Int. Cl.

| | |
|---|---|
| ***E06B 7/16*** | (2006.01) |
| ***E06B 1/60*** | (2006.01) |
| ***E06B 1/62*** | (2006.01) |
| *E06B 7/205* | (2006.01) |

(Continued)

(52) U.S. Cl.

CPC ..... *E06B 1/60* (2013.01); *E06B 1/62* (2013.01); *E06B 7/16* (2013.01); *E06B 7/205* (2013.01); *E06B 7/22* (2013.01); *E06B 7/23* (2013.01); *E06B 2001/628* (2013.01)

(58) Field of Classification Search

CPC ... E06B 7/16; E06B 1/60; E06B 7/205; E06B 7/22; E06B 7/23

See application file for complete search history.

(56) References Cited

U.S. PATENT DOCUMENTS

2003/0221381 A1* 12/2003 Ting ..... E06B 1/02 52/204.1
2011/0296777 A1* 12/2011 Matta ..... E06B 1/342 52/208

FOREIGN PATENT DOCUMENTS

| | | | | |
|---|---|---|---|---|
| CA | 2824184 A1 * | 2/2014 | ..... | E06B 3/26303 |
| CA | 2884612 A1 * | 2/2016 | ..... | E04F 13/08 |
| DE | 2006149 A1 * | 9/1971 | ..... | E06B 1/60 |

(Continued)

OTHER PUBLICATIONS

English translation of Decision to Grant a Patent drafted by the Japan Patent Office dated Aug. 8, 2016.

(Continued)

*Primary Examiner* — Babajide Demuren
(74) *Attorney, Agent, or Firm* — Birch, Stewart, Kolasch & Birch, LLP

(57) ABSTRACT

An exterior wall structure includes first to fourth waterproofing members. Each of the first to fourth waterproofing members includes a fixing portion, a positioning portion, a separating portion, a supporting portion, and first and second seal portions. The positioning portion extends continuously with the fixing portion toward the exterior side. The positioning portion positions an exterior wall material by coming into abutment with an end face of the exterior wall material. The separating portion extends continuously with the positioning portion toward the sash body side so as to be located between the sash body and the exterior wall material. The first seal portion inhibits the entry of water by coming into abutment with the exterior wall material. The second seal portion inhibits the entry of water by coming into abutment with the sash body.

14 Claims, 8 Drawing Sheets

(51) Int. Cl.
*E06B 7/23* (2006.01)
*E06B 7/22* (2006.01)

(56) References Cited

FOREIGN PATENT DOCUMENTS

| | | | | | |
|---|---|---|---|---|---|
| EP | 2845980 | A2 | * | 3/2015 | ..... E06B 1/342 |
| GB | 2046335 | A | * | 11/1980 | ..... E06B 1/70 |
| GB | 2049770 | A | * | 12/1980 | ..... E06B 1/70 |
| JP | 2-112826 | U | | 9/1990 | |
| JP | 7-300980 | A | | 11/1995 | |
| JP | 9-296527 | A | | 11/1997 | |
| JP | 2004-11380 | A | | 1/2004 | |
| JP | 2009-41181 | A | | 2/2009 | |
| JP | 2012001967 | A | * | 1/2012 | |
| JP | 5946870 | B2 | * | 7/2016 | ..... E04F 13/08 |

OTHER PUBLICATIONS

English translation of Notification of Reasons for Refusal drafted by the Japan Patent Office dated Apr. 26, 2016.
English translation of Notification of Reasons for Refusal drafted by the Japan Patent Office dated Jan. 27, 2016.
English translation of Written Amendment filed in the Japan Patent Office dated Apr. 1, 2016.
English translation of Written Amendment filed in the Japan Patent Office dated Jul. 25, 2016.
English translation of Written Argument filed in the Japan Patent Office dated Apr. 1, 2016.
English translation of Written Argument filed in the Japan Patent Office dated Jul. 25, 2016.

* cited by examiner

WATERPROOFING MEMBER AND EXTERIOR WALL STRUCTURE

CROSS REFERENCE TO RELATED APPLICATIONS

This application is based on Japanese Patent Application No. 2015-049037 filed with the Japanese Patent Office on Mar. 12, 2015, the entire content of which is hereby incorporated by reference.

BACKGROUND OF THE INVENTION

1. Field of the Invention

The present invention relates to a waterproofing member and an exterior wall structure using the same.

2. Description of the Related Art

For example, opening members such as a window sash and a door, as well as exterior wall materials and the like formed of a ceramic material such as cement are mounted to a building such as a house. In such a building, an opening is defined by a frame member such as a column member in a location where a window, an entrance, or the like is disposed, and this opening provides communication between the exterior side and the interior side. A wall backing member such as a furring strip is mounted to the frame member. As a result of mounting an exterior wall material to the building, the wall backing member is located between the frame member and the interior side of the exterior wall material.

The opening member includes an opening member body. The opening member body is disposed within the opening as a result of mounting the opening member to the frame member. Consequently, the opening member body enables opening and closing of the opening, in other words, a window, an entrance, or the like.

The exterior wall material is mounted to the wall backing member around the opening member, while the exterior wall materials are positioned in a state in which it is spaced apart from the opening member body at a certain interval. To mount the exterior wall material to the wall backing member in this manner, a securing member as disclosed in JP 2009-41181A may be used, for example. The securing member is provided with a securing portion capable of engaging the exterior wall material. The securing member is fixed to the wall backing member by being screwed to the wall backing member. A plurality of securing members are fixed to the wall backing member in this way, and the exterior wall material is secured to the securing portions, and thereby, the exterior wall material is mounted to the wall backing member while the exterior wall materials are positioned in the manner described above.

For such a building, waterproofing of the building is performed between the opening member and the exterior wall material in order to prevent the entry of rainwater or the like into the interior side. In general, such waterproofing is performed by filling between the opening member body and the exterior wall material with a caulking compound or the like after the exterior wall material has been mounted to the wall backing member (See JP 2009-41181A).

SUMMARY OF THE INVENTION

However, to perform accurate positioning of the exterior wall material by using the above-described conventional securing members, a high precision is required for the positions of the securing members relative to each other when the securing members are mounted to the wall backing member. At this time, separately mounting each of the securing members to the wall backing member tends to cause variations between the positions of the securing member relative to each other. To suppress such variations, each of the securing members needs to be carefully positioned and mounted to the wall backing member. Consequently, the above-described securing members and the exterior wall structure using the same increase the complexity of the operation of mounting the securing members and the exterior wall material to the wall backing member while positioning these components. Accordingly, installation requires a skilled technician and consumes a large amount of time, resulting in an increase in the cost required for the installation.

To waterproof the building, when filling between the opening member body and the exterior wall material with a caulking compound or the like after the exterior wall material has been mounted to the wall backing member, the number of steps required for the installation increases accordingly. Furthermore, the waterproofing capability tends to vary among locations filled with the caulking compound or the like. Accordingly, in waterproofing the building, the installation becomes complex, and a large amount of working time is needed.

The present invention has been made in view of the above-described conventional circumstances, and it is an object of the invention to provide a waterproofing member and an exterior wall structure that accurately position the exterior wall material, ensure the waterproofness of the building to which the opening member and the exterior wall material are mounted, and achieve easy installation.

In a waterproofing member for performing waterproofing of a building according to an aspect of the present invention, the building includes:

a frame member defining an opening that provides communication between an exterior side and an interior side;

an exterior wall material configured to be mounted on the exterior side of the frame member;

a wall backing member that is mounted to the frame member, and is located between the frame member and the exterior wall material; and an opening member including an opening member body disposed in the opening.

The waterproofing member includes:

a fixing portion configured to be fixed to at least one of the wall backing member and the frame member at a time of installation when the waterproofing member is installed between the wall backing member and the exterior wall material;

a positioning portion joined to the fixing portion, and extending toward the exterior side so as to face an end face of the exterior wall material at the time of the installation;

a separating portion joined to the positioning portion, and extending toward the opening member body side so as to be located between the opening member body and the exterior wall material at the time of the installation;

a supporting portion joined to the separating portion, and facing the opening member body at the time of the installation;

a first seal portion provided on at least one of the fixing portion and the positioning portion, and coming into abutment with the exterior wall material at the time of the installation; and a second seal portion provided on the supporting portion, and coming into abutment with the opening member body at the time of the installation.

With the waterproofing member according to the present invention, it is possible to accurately position the exterior wall material, ensure the waterproofness of the building to which the opening member and the exterior wall material are mounted, and achieve easy installation. According to an exterior wall structure using the waterproofing member according to the present invention, it is possible to accurately position the exterior wall material, ensure the waterproofness of the building to which the opening member and the exterior wall material are mounted, and achieve easy installation.

DESCRIPTION OF THE EMBODIMENT

Figure 1:
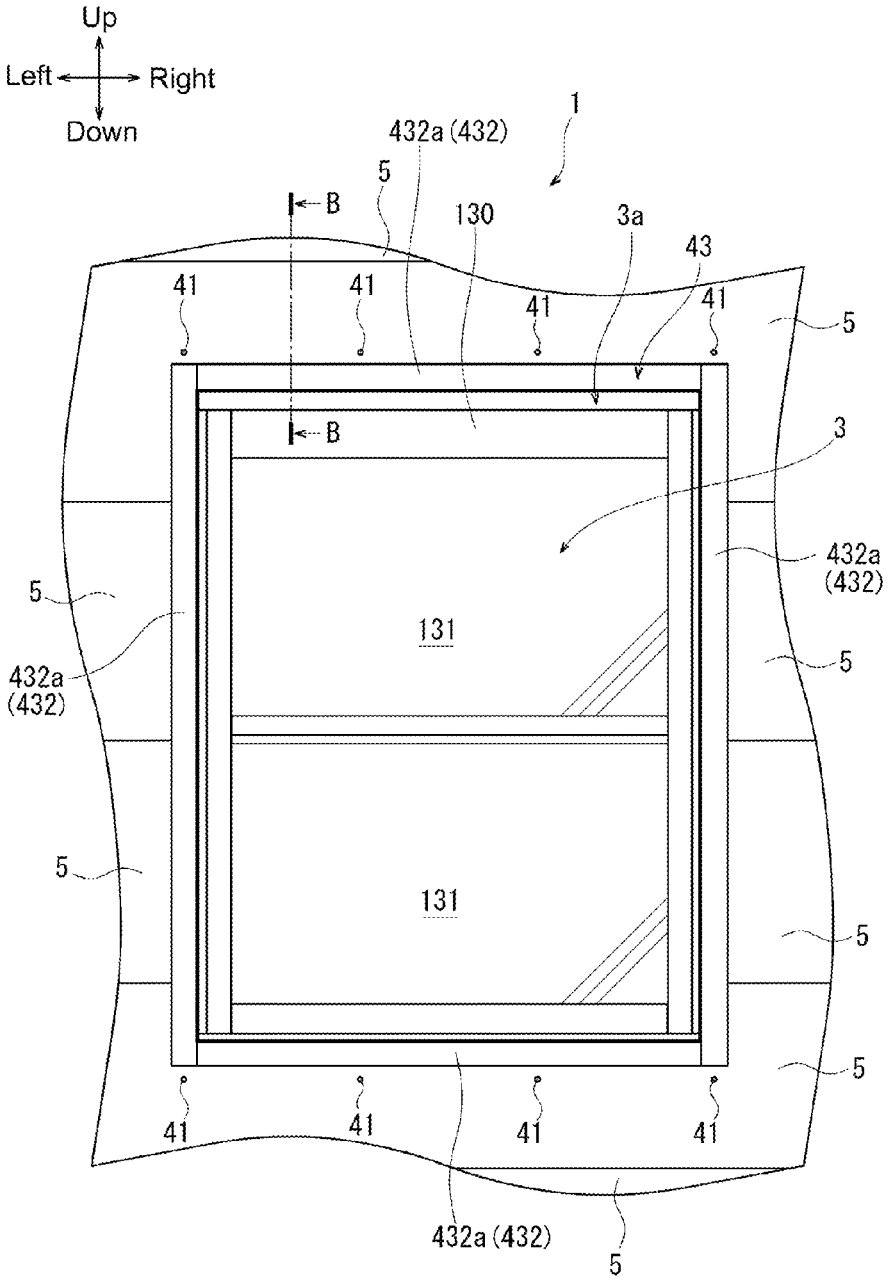
FIG. 1 is a partial front view showing a part of a building that uses an exterior wall structure according to an embodiment.

A waterproofing member according to an aspect of the present invention is a waterproofing member that is provided in a building to which an opening member and an exterior wall material are mounted, and waterproofs the building between the opening member and the exterior wall material.

The building includes a frame member defining an opening that provides communication between an exterior side and an interior side, and a wall backing member that is mounted to the frame member and is located between the frame member and the interior side of the exterior wall material, wherein the opening member includes an opening member body disposed within the opening.

The waterproofing member includes: a fixing portion that is fixed to the wall backing member and is located between the wall backing member and the exterior wall material;

a positioning portion that extends continuously with the fixing portion toward the exterior side, and positions the exterior wall material by coming into abutment with an end face of the exterior wall material;

a separating portion that extends continuously with the positioning portion toward the opening member body side, and is located between the opening member body and the exterior wall material;

a supporting portion that is continuous with the separating portion and faces the opening member body;

a first seal portion that is provided on the fixing portion or the positioning portion to inhibit the entry of water by coming into abutment with the exterior wall material; and a second seal portion that is provided on the supporting portion to inhibit the entry of the water by coming into abutment with the opening member body.

With the waterproofing member according to the present aspect, the fixing portion is fixed to the wall backing member in a state in which the second seal portion is brought into abutment with the opening member body. This enables positioning when the waterproofing member is fixed to the wall backing member. Then, in a state in which the waterproofing member is fixed to the wall backing member, an end face of the exterior wall material is brought into abutment with the positioning portion of the waterproofing member. Thereby, with this waterproofing member, it is possible to position the exterior wall material with the positioning portion, while defining the interval between the opening member body and the exterior wall material by the separating portion. Accordingly, with the waterproofing member, it is possible to position the exterior wall material easily and accurately, without requiring a skilled technician. Note that the exterior wall material that has been positioned by the waterproofing member in this manner is fixed to the wall backing member, for example, by means of a fastener such as a nail.

Also, with this waterproofing member, the first seal portion is provided on the fixing portion, and the second seal portion is provided on the supporting portion. Thus, with the waterproofing member, by simply fixing the fixing portion to the wall backing member and bringing the end face of the exterior wall material into abutment with the positioning portion in the above-described manner, it is possible to prevent the entry of water from between the waterproofing member and the exterior wall material with the first seal portion, and prevent the entry of water from between the waterproofing member and the opening member body with the second seal portion. Accordingly, with the waterproofing member, it is possible to omit filling a caulking compound or the like between the opening member body and the exterior wall material to waterproof the building, or reduce the number of filling locations even when partially filling a caulking compound or the like. Due to a reduced number of locations filled with a caulking compound or the like, it is also possible to suppress variations in the waterproofing capability among the locations filled with the caulking compound or the like. Consequently, with the waterproofing member, it is possible to easily waterproof the building.

Accordingly, with the waterproofing member according to the present aspect, it is possible to accurately position the exterior wall material, ensure the waterproofness of the building to which the opening member and the exterior wall material are mounted, and achieve easy installation.

Preferably, the separating portion is located on the interior side with respect to the outer surface of the exterior wall material. In this case, the separating portion does not protrude to the exterior side with respect to the exterior wall material, and therefore, the separating portion is less noticeable between the opening member body and the end face of the exterior wall material when the building is viewed from the exterior side. This enhances the aesthetic appearance of the building.

Preferably, the separating portion is formed flat. In this case, no projection or the like is formed on the separating portion, and therefore, the waterproofing member is formed easily. When a facing member that covers between the opening member body and the end face of the exterior wall material is mounted to the separating portion, the mounting of the facing member is facilitated. Furthermore, since the separating portion is flat, it is possible to enhance the aesthetic appearance of the building even without the above-described facing member mounted to the separating portion.

An exterior wall structure according the present aspect is an exterior wall structure for waterproofing a building between an opening member and an exterior wall material that are mounted to the building, by using a waterproofing member provided in the building.

The building includes a frame member defining an opening that provides communication between an exterior side and an interior side, and a wall backing member that is mounted to the frame member and is located between the frame member and the interior side of the exterior wall material, wherein the opening member includes an, opening member body disposed within the opening.

The waterproofing member includes: a fixing portion that is fixed to the wall backing member and is located between the wall backing member and the exterior wall material;

a positioning portion that extends continuously with the fixing portion toward the exterior side, and positions the exterior wall material by coming into abutment with an end face of the exterior wall material;

a separating portion that extends continuously with the positioning portion toward the opening member body side, and is located between the opening member body and the exterior wall material;

a supporting portion that is continuous with the separating portion and faces the opening member body;

a first seal portion that is provided on the fixing portion or the positioning portion to inhibit the entry of water by coming into abutment with the exterior wall material; and a second seal portion that is provided on the supporting portion to inhibit the entry of the water by coming into abutment with the opening member body.

For the exterior wall structure according to the present aspect, a waterproofing member having the above-described features is used. With this exterior wall structure, it is possible to position the exterior wall material easily and accurately. With this exterior wall structure, it is also possible to omit filling a caulking compound or the like between the opening member body and the exterior wall material to waterproof the building, or to reduce the number of filling locations even when partially filling a caulking compound or the like. Thereby, with this exterior wall structure, it is also possible to easily waterproof the building.

Accordingly, with the exterior wall structure according to the present aspect, it is possible to accurately position the exterior wall material, ensure the waterproofness of the building to which the opening member and the exterior wall material are mounted, and achieve easy installation.

Hereinafter, an embodiment of the present invention will be described with reference to the accompanying drawings.

An exterior wall structure according to the embodiment is used for a building 1 as a house shown in FIG. 1. A window sash 3 and a plurality of exterior wall materials 5 are mounted to the building 1. The window sash 3 is an example of an opening member according to the present invention. Note that the upward direction of FIG. 1 indicates the upward direction of the window sash 3. In other words, the up-down direction of FIG. 1 is the up-down direction of the building 1 when viewed from the exterior side. The rightward direction of FIG. 1 indicates the rightward direction when the window sash 3 is viewed from the exterior side. In other words, the left-right direction of FIG. 1 is the left-right direction when the building 1 is viewed from the exterior side. In FIGS. 2 to 8, the up-down direction and the left-right direction are defined so as to correspond to those of FIG. 1, and the exterior side and the interior side of the building 1 are indicated.

Figure 2:
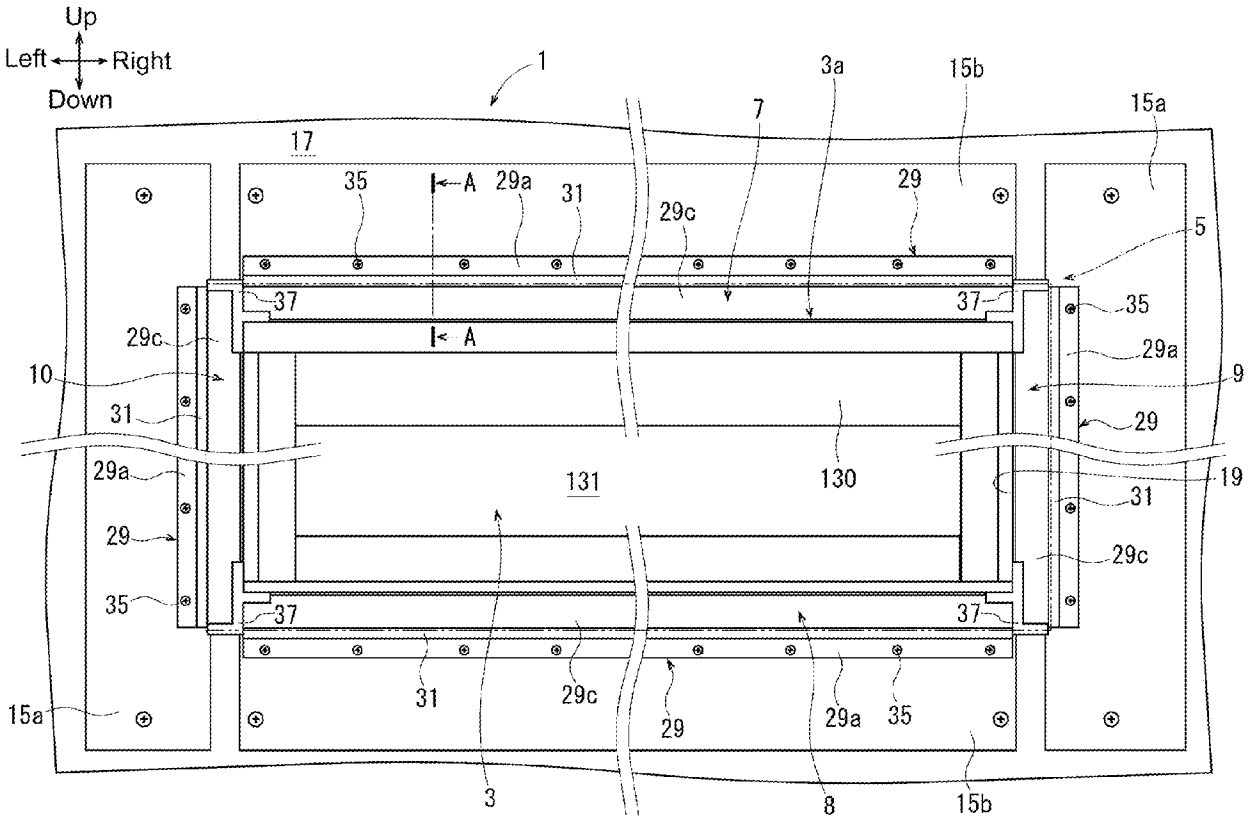
FIG. 2 is a partial front view of the exterior wall structure according to an embodiment, showing an area surrounding an opening member.

As shown in FIG. 2; the exterior wall structure includes first to fourth waterproofing members 7 to 10. In this exterior wall structure, the first to fourth waterproofing members 7 to 10 are used to position the exterior wall materials 5 around the window sash 3, and to waterproof the building 1 between the window sash 3 and the exterior wall materials 5. For the ease of illustration, the exterior wall materials 5 are depicted by the phantom line in FIG. 2, and the illustration of a facing member 43, which will be described later, has been omitted therefrom.

Figure 3:
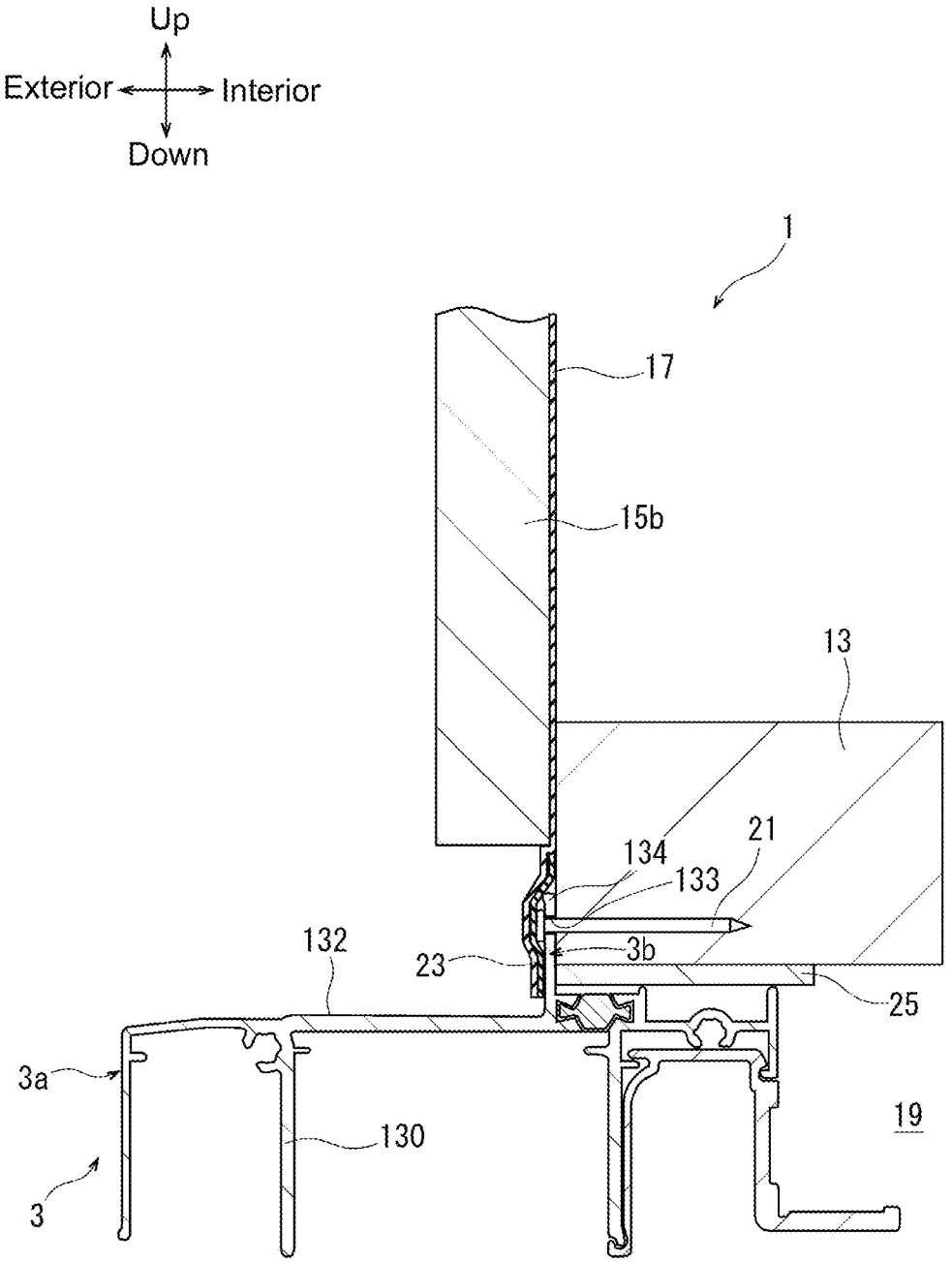
FIG. 3 is an enlarged cross-sectional view of a principal part of the exterior wall structure according to an embodiment, showing a state in which the opening member is mounted to the building.

The building 1 is a wooden building, and includes frame members 13 shown in FIG. 3, as well as a plurality of vertical furring strips 15*a*, a plurality of horizontal furring strips 15*b*, and the like shown in FIG. 2. The vertical furring strips 15*a* and the horizontal furring strips 15*b* are examples of wall backing members according to the present invention. Specifically, the frame members 13 are continuous columns, stand columns, studs, window sills, lintels, and the like in the building 1. It is also possible to use plywood or the like as the wood for the vertical furring strips 15*a* and the horizontal furring strips 15*b* as the wall backing members. Furthermore, the frame members 13 and the like are not necessarily formed of wood, and is applicable to be formed of other materials.

The building 1 is constructed by assembling the frame members 13, the vertical furring strips 15*a*, the horizontal furring strips 15*b* and the like by a known construction technique. Note that a plurality of the frame members 13 are provided, and only one of the frame members 13 is shown in FIG. 3 and FIGS. 6 to 8, which will be described later. As shown in FIG. 2, a waterproof sheet 17 is provided between the frame members 13 and the vertical furring strips 15*a* and the horizontal furring strips 15*b*.

In the building 1, the plurality of frame members 13 are assembled into a frame, thus defining a rectangular opening 19 as shown in FIG. 2. The opening 19 corresponds to a window of the building 1, and provides communication between the exterior side and the interior side of the building 1 as shown in FIG. 3. As shown in FIG. 2, the vertical furring strips 15*a* are fixed to the frame members 13 on the right side and the left side of the opening 19. On the other hand, the horizontal furring strips 15*b* are fixed to the frame members 13 above and below the opening 19. Consequently, the opening 19 is surrounded by the vertical furring strips 15*a* and the horizontal furring strips 15*b*. In addition, as a result of the exterior wall materials 5 mounted to the building 1, the vertical furring strips 15*a* and the horizontal furring strips 15*b* are located between the frame members 13 and the interior side surfaces of the exterior wall materials 5.

The window sash 3 shown in FIG. 1 is a commercially available product, and includes a sash body 3*a* and a flange 3*b* shown in FIG. 3. The sash body 3*a* is an example of the opening member body according to the present invention. As shown in FIG. 1, the sash body 3*a* includes a plurality of frames 130 made of an aluminum alloy and a plurality of window glass sheets 131 mounted to the frames 130. Consequently, the sash body 3*a* is a rectangular shaped frame.

As shown in FIG. 3, the flange 3*b* is provided integrally with the sash body 3*a*. The flange 3*b* extends at a substantially right angle outward in the width direction from an outer surface 132 of the sash body 3*a*. In addition, a plurality of mounting holes 133 are formed in the flange 3*b*. Each of the mounting holes 133 is formed in the flange 3*b* inward of a distal end portion 134 in the width direction, or in other words, at a position that is closer to the sash body 3*a* than the distal end portion 134.

This exterior wall structure is installed by performing the following steps.

First, an opening member mounting step is performed in which the window sash 3 is mounted to the building 1. Specifically, the flange 3*b* is brought into abutment with the exterior side of the frame member 13, with the sash body 3*a* disposed within the opening 19. In this state, a nail 21 is inserted into each of the mounting holes 133, and the nails 21 are driven into the frame member 13 from the exterior side, thus fixing the flange 3*b* on the exterior side of the frame member 13. Here, as described above, each of the mounting holes 133 is formed at a position nearer to the sash body 3*a* than the distal end portion 134 of the flange 3*b*. Accordingly, the flange 3*b* is fixed on the exterior side of the frame member 13 at a position nearer to the sash body 3*a* than the distal end portion 134. After the flange 3*b* has been fixed to the frame member 13, a waterproof tape 23 is attached to the frame member 13. Additionally, the above-described waterproof sheet 17 is installed on the exterior side of the waterproof tape 23. Due to the above, waterproof treatment between the frame member 13 and the flange 3*b* is provided. Note that the flange 3*b* is fixed to the frame member 13 by means other than the nails 21, such as screws or the like.

Although not shown, a plurality of mounting holes are formed in the sash body 3*a*, and the sash body 3*a* is fixed to the frame member 13 also by means of mounting screws inserted through these mounting holes. To mount the window sash 3 to the building 1, a spacer member 25 is optionally provided as appropriate between the frame member 13 and the sash body 3*a*. In this way, the window sash 3 is provided in the building 1, thus completing the opening member mounting step.

Next, a waterproofing member mounting step is performed in which each of the first to fourth waterproofing members. 7 to 10 shown in FIG. 2 is mounted to the building 1 around the sash body 3*a*. The first to fourth waterproofing members 7 to 10 have substantially the same configuration except that their lengths in the longitudinal direction are defined according to the size of the sash body 3*a*, in other words, the size of the opening 19. In the following, this configuration will be described in detail based on the configuration of the first waterproofing member 7.

Figure 4:
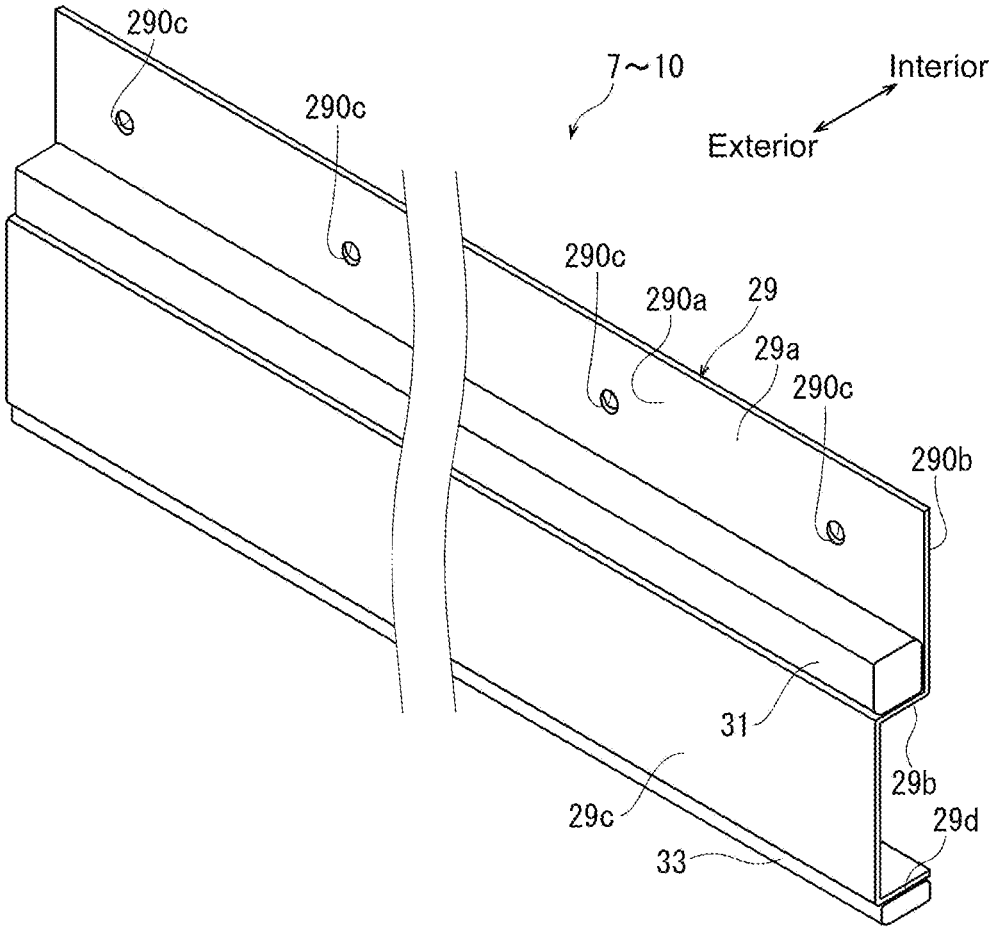
FIG. 4 is a perspective view of the exterior wall structure according to an embodiment, showing a waterproofing member.

As shown in FIG. 4, the first waterproofing member 7 includes a waterstop body 29, a first seal portion 31, and a second seal portion 33.

Figure 5:
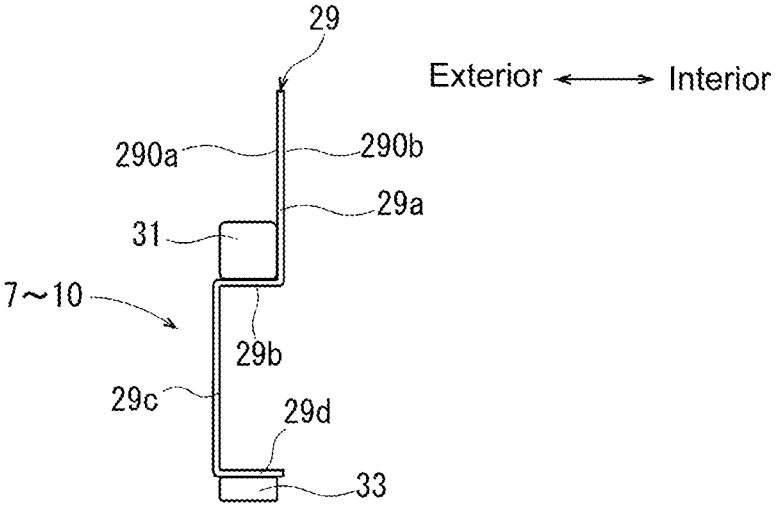
FIG. 5 is a side view of the exterior wall structure according to an embodiment, showing the waterproofing member.

The waterstop body 29 is formed of a metal plate extending from one end side to the other end side in the width direction and also extending in the longitudinal direction, and has an exterior face 290*a* and an interior face 290*b* as shown in FIG. 5. The exterior face 290*a* faces the exterior side when each of the first to fourth waterproofing members 7 to 10 is mounted to the building 1. The interior face 290*b* is the back surface of the exterior face 290*a*, and faces the interior side when each of the first to fourth waterproofing members 7 to 10 is mounted to the building 1. The length of the waterstop bodies 29 of the first and second waterproofing members 7 and 8 in the longitudinal direction is defined according to the length of the sash body 3*a* in the left-right direction as shown in FIG. 2. On the other hand, the length of the waterstop bodies 29 of the third and fourth waterproofing members 9 and 10 in the longitudinal direction is defined according to the length of the sash body 3*a* in the up-down direction. Note that the waterstop body 29 is formed of a material other than a metal plate.

Figure 6:
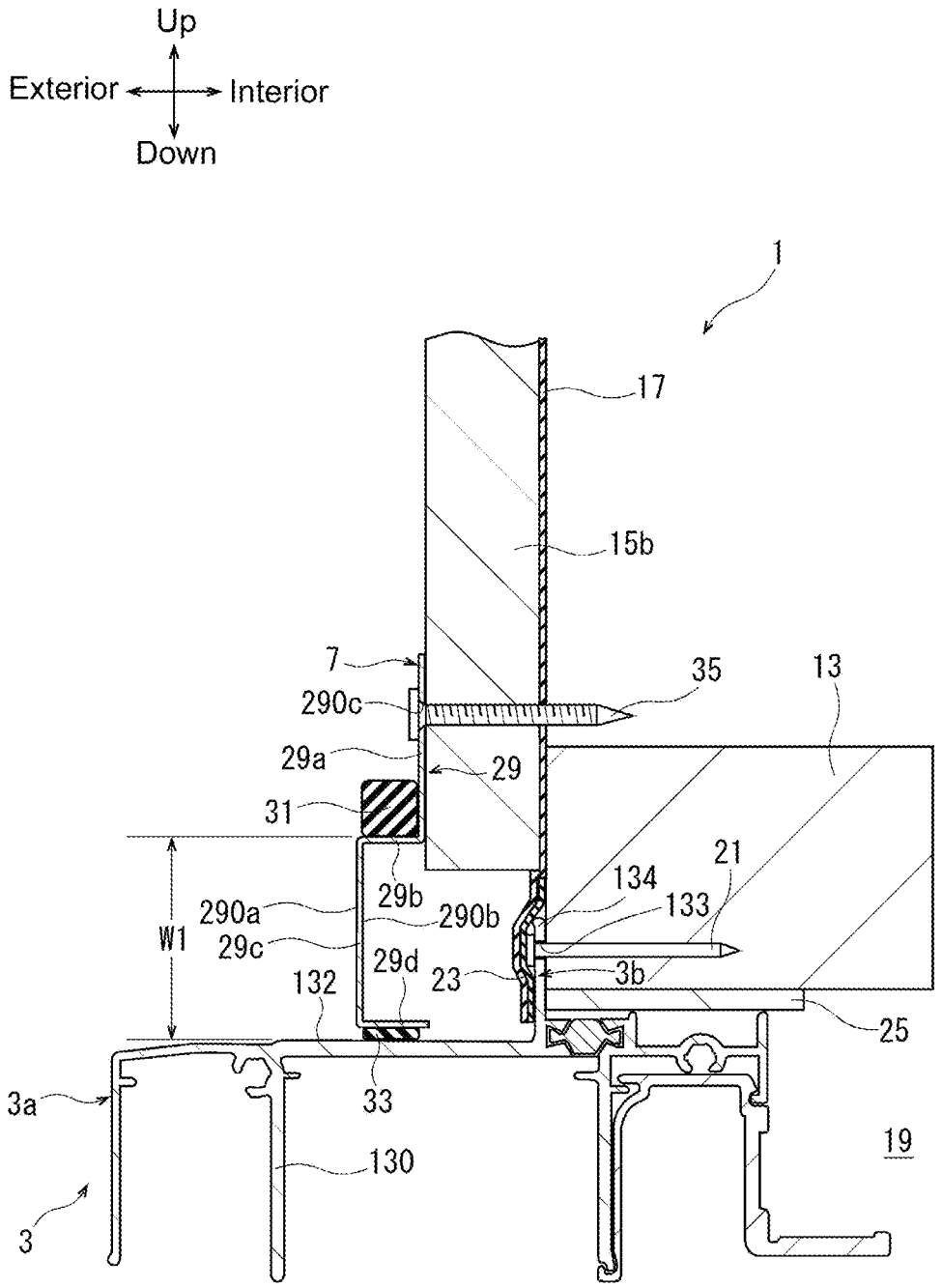
FIG. 6 is an enlarged cross-sectional view of a principal part of the exterior wall structure according to an embodiment, showing a state in which the opening member and the waterproofing member are mounted to the building.

As shown in FIG. 4, a fixing portion 29*a*, a positioning portion 29*b*, a separating portion 29*c*, and a supporting portion 29*d* are integrally formed with the waterstop body 29 by press working. The fixing portion 29*a* extends in the width direction from an end portion on one end side of the waterstop body 29 toward the other end side. A plurality of mounting holes 290*c* are formed in the fixing portion 29*a*. Here, as shown in FIG. 6, each of the mounting holes 290*c* is formed in the fixing portion 29*a* such that the distance from the outer surface 132 of the sash body 3*a* to the mounting hole 290*c* is farther (longer) than the distance from the outer surface 132 of the sash body 3*a* to the end portion of the flange 3*b* when each of the first to fourth waterproofing members 7 to 10 is disposed around the sash body 3*a*. Note that the length of the fixing portion 29*a* in the width direction and the number of the mounting holes 290*c* are situationally designed as appropriate.

As shown in FIGS. 4 and 5, the positioning portion 29*b* is bent at a substantially right angle toward the exterior side from the end portion on the other end side of the fixing portion 29*a*, and thereby extends toward the exterior side while being continuous with the fixing portion 29*a*. Here, the length by which the positioning portion 29*b* extends to the exterior side is designed so as to be shorter than the length of the exterior wall material 5 in the thickness direction, which will be described later.

The separating portion 29*c* is bent at a substantially right angle toward the other end side of the waterstop body 29 from the end portion on the exterior side of the positioning portion 29*b*, and thereby extends in the width direction toward the other end side of the waterstop body 29 while being continuous with the positioning portion 29*b*. That is, as shown in FIG. 6, the separating portion 29*c* is formed so as to extend in the width direction toward the sash body 3*a* side from the end portion on the exterior side of the positioning portion 29*b* when each of the first to fourth waterproofing members 7 to 10 is mounted to the building 1. The length of the separating portion 29*c* in the width direction is designed such that the interval from the outer surface 132 of the sash body 3*a* to the positioning portion 29*b* is equal to an interval W1 when each of the first to fourth waterproofing members 7 to 10 is mounted to the building 1. The interval W1 corresponds to the below-described interval from the outer surface 132 of the sash body 3*a* to the end face of the exterior wall material 5, and is set to about 30 mm, for example, in this exterior wall structure.

As shown in FIGS. 4 and 5, in the separating portion 29*c*, no projection or the like protruding toward the exterior side or the interior side is formed on the exterior face 290*a* and the interior face 290*b*. That is, the separating portion 29*c* is formed so as to extend in the width direction in a flat manner.

The supporting portion 29*d* is bent at a substantially right angle toward the interior side from the end portion on the other end side of the separating portion 29*c*, and thereby extends toward the interior side while being continuous with the separating portion 29*c*. Note that the supporting portion

29*d* is alternatively formed by being bent toward the exterior side from the end portion on the other end side of the separating portion 29*c*

The first seal portion 31 and the second seal portion 33 are formed of an ethylene-propylene rubber (EPDM) having a rectangular shape. Note that the first seal portion 31 and the second seal portion 33 are not necessarily formed of EPDM, and are formed of a synthetic rubber or various materials capable of inhibiting the entry of water. In addition, the first seal portion 31 and the second seal portion 33 are formed of mutually different materials.

The length of the first and second seal portions 31 and 33 in the longitudinal direction is defined according to the length of the waterstop body 29 in the longitudinal direction. The first seal portion 31 is attached to the exterior face 290*a* of the fixing portion 29*a*. The first seal portion 31 is in contact with the positioning portion 29*b*, but is not bonded thereto. Consequently, the first seal portion 31 is located at a corner portion formed by the fixing portion 29*a* and the positioning portion 29*b* so as to be in contact with the fixing portion 29*a* and the positioning portion 29*b*.

Figure 7:
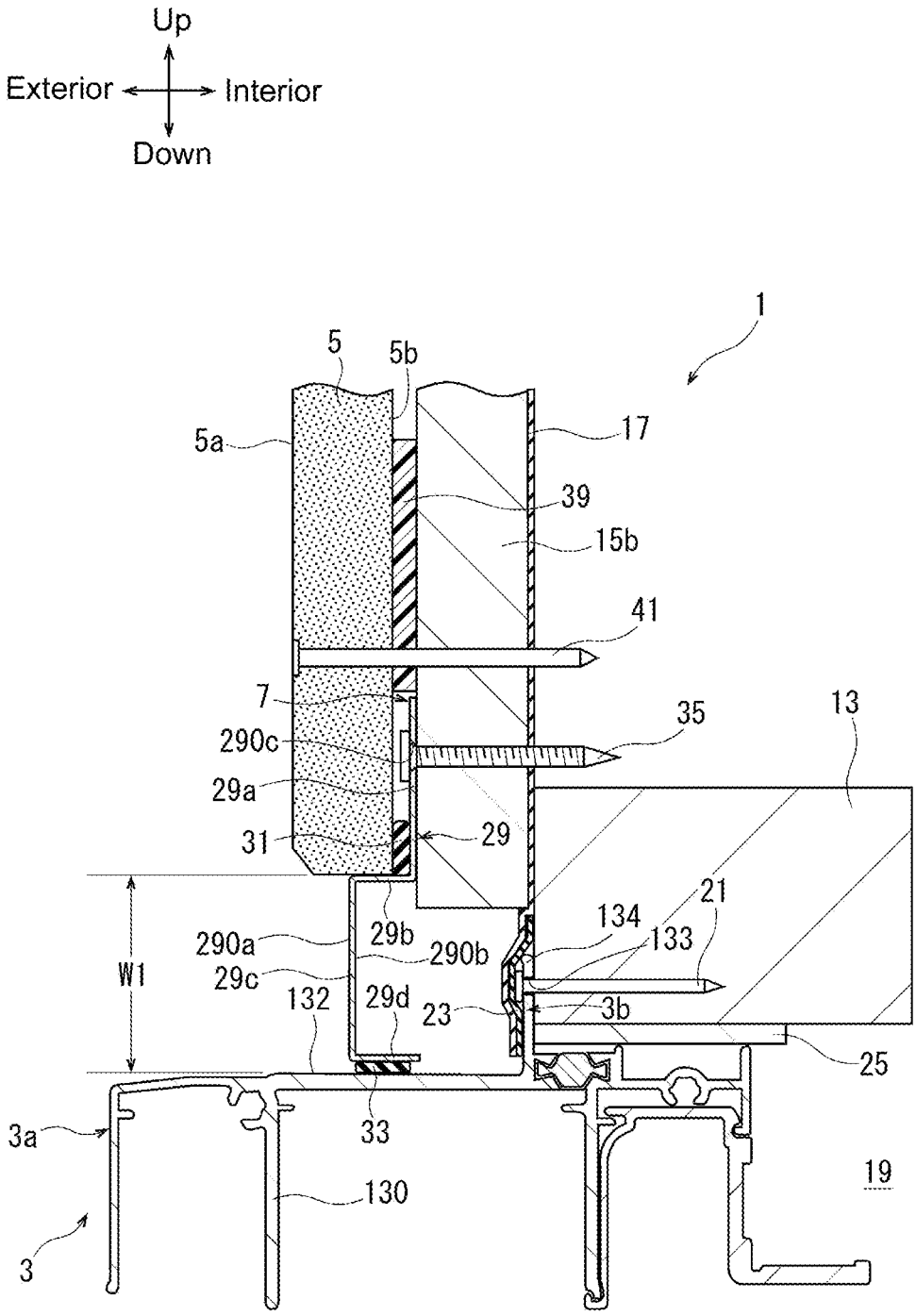
FIG. 7 is an enlarged cross-sectional view of a principal part of the exterior wall structure according to an embodiment, taken along the line A-A in FIG. 2.

When the first seal portion 31 is not bonded onto the positioning portion 29*b* as in this case, the lower end face of the exterior wall material 5 is positioned by being brought into direct contact with the flat positioning portion 29*b* while the first seal portion 31 is being compressed as shown in FIG. 7. Accordingly, it is possible to accurately position the exterior wall material 5.

However, in cases such as when positioning is not required to be accurate for the exterior wall material 5, it is possible to adopt a configuration in which the first seal portion 31 is bonded onto the positioning portion 29*b*.

The second seal portion 33 is provided on the supporting portion 29*d* by being attached to the supporting portion 29*d*. The second seal portion 33 is formed to be thinner than the first seal portion 31. Note that the second seal portion 33 is optionally formed to have the same thickness as that of the first seal portion 31, or is optionally formed to be thicker than the first seal portion 31.

To mount the first waterproofing member 7 to the building 1, first, the first waterproofing member 7 is disposed above the sash body 3*a* as shown in FIG. 6. Then, while the supporting portion 29*d* is being faced with the outer surface 132 of the sash body 3*a*, the second seal portion 33 is brought into abutment with the outer surface 132. At this time, the outer surface 132 and the second seal portion 33 are attached to each other with a double-sided adhesive tape (not shown). Thus, the first waterproofing member 7 is positioned above the sash body 3*a*. Thereafter, while the second seal portion 33 is being pressed against the outer surface 132, the fixing portion 29*a* is fixed to the horizontal furring strip 15*b* from the exterior side by means of first mounting screws 35, which are fasteners inserted through the mounting holes 290*c*. As a result of the fixing portion 29*a* having been fixed to the horizontal furring strip 15*b* in this way, the second seal portion 33 comes into abutment with the outer surface 132 in a state in which it is compressed and deformed between the supporting portion 29*d* and the outer surface 132. Thus, the first waterproofing member 7 is mounted to the building 1 above the sash body 3*a*. Note that the fixing portion 29*a* is optionally fixed to the horizontal furring strip 15*b* by means of nails, instead of the first mounting screws 35. The fixing portion 29*a* is situationally fixed to the horizontal furring strip 15*b* and the frame member 13.

Here, as described above, each of the mounting holes 290*c* is formed in the fixing portion 29*a* such that the distance from the outer surface 132 of the sash body 3*a* is farther than the distance from the end portion of the flange 3*b*. Accordingly, the fixing portion 29*a* is fixed to the horizontal furring strip 15*b* by the first mounting screws 35 at positions spaced farther away from the outer surface 132 than the end portion of the flange 3*b*, or in other words, at positions where the flange 3*b* is not present. Consequently, in this exterior wall structure, the distal ends of the first mounting screws 35 contact with neither the flange 3*b*, nor the waterproof tape 23 when the fixing portion 29*a* is fixed to the horizontal furring strip 15*b*.

By following the same procedure, the second waterproofing member 8 is fixed to the horizontal furring strip 15*b* below the sash body 3*a* as shown in FIG. 2, and is thereby mounted to the building 1. Additionally, the third waterproofing member 9 is fixed to the vertical furring strip 15*a* on the right side of the sash body 3*a*, and is thereby mounted to the building 1. Then, the fourth waterproofing member 10 is fixed to the vertical furring strip 15*a* on the left side of the sash body 3*a*, and is thereby mounted to the building 1. Thus, the waterproofing member mounting step is completed.

After completion of the waterproofing member mounting step, a caulking compound filling step for filling with a caulking compound 37 is performed. Specifically, the caulking compound 37 fills each of the gaps between the first waterproofing member 7 and the third waterproofing member 9, the gap between the third waterproofing member 9 and the second waterproofing member. 8, the gap between the second waterproofing member 8 and the fourth waterproofing member 10, and the gap between the fourth waterproofing member 10 and the first waterproofing member 7. Additionally, the caulking compound 37 also fills each of the gaps between the first and third waterproofing members 7 and 9 and the upper right corner portion of the sash body 3*a*, the gap between the second and third waterproofing members 8 and 9 and the lower right corner portion of the sash body 3*a*, the gap between the second and fourth waterproofing members 8 and 10 and the lower left corner portion of the sash body 3*a*, and the gap between the first and fourth waterproofing members 7 and 10 and the upper left corner portion of the sash body 3*a*. Furthermore, the caulking compound 37 also fills the upper end and the lower end of each of the third and fourth waterproofing members 9 and 10. Due to the above, the gap between the first waterproofing member 7 and the third waterproofing member 9, and the like are each closed with the caulking compound 37, thus preventing rainwater or the like from flowing into the interior side through the gap between the first waterproofing member 7 and the third waterproofing member 9, and the like.

Here, for example, the gap between the first waterproofing member 7 and the third waterproofing member 9 is closed not only by the caulking compound 37, but also by the second seal portion 33 of the third waterproofing member 9. The other gaps; including for example, the gap between the third waterproofing member 9 and the second waterproofing member 8, are also closed by the second seal portion 33 in the same manner. Consequently, with this exterior wall structure, it is possible, also by the second seal portion 33, to prevent rainwater or the like from flowing into the interior side through the gap between the first waterproofing member 7 and the third waterproofing member 9, and the like. Accordingly, although the entry of rainwater or the like into the interior side, for example, from the gap between the first waterproofing member 7 and the third waterproofing member 9 is fully prevented by filling with the caulking compound 37, the caulking compound filling step is not essential for this exterior wall structure, and is omissible. It is also possible to omit some of the locations filled with the caulking compound 37 during the caulking compound filling step.

Next, an exterior wall material mounting step is performed in which a plurality of exterior wall materials 5 are mounted to the building 1. Each of the exterior wall materials 5 is formed of a ceramic material. As such an exterior wall material 5, it is possible to use, for example, "MOEN EXCELARD (Japanese registered trademark)" manufactured by "NICHIHA CORPORATION". As shown in FIG. 7, each of the exterior wall materials 5 has an outer surface 5*a* facing the exterior side and a back surface 5*b* facing the interior side. Note that it is also possible to use an exterior wall material formed of a material other than a ceramic material as the exterior wall material 5.

To mount the exterior wall material 5 to the building 1 above the sash body 3*a*, the lower end face of the exterior wall material 5 is brought into abutment with the positioning portion 29*b* of the first waterproofing member 7 as shown in FIG. 7. Here, as described above, the positioning portion 29*b* is formed to be shorter than the length of the exterior wall material 5 in the thickness direction, and therefore, the positioning portion 29*b* comes into abutment with about a half of the lower end face of the exterior wall material 5. By bringing the lower end face of the exterior wall material 5 into abutment with the positioning portion 29*b* in this way, the separating portion 29*c* is located between the outer surface 132 of the sash body 3*a* and the lower end face of the exterior wall material 5 above the sash body 3*a*. Consequently, the exterior wall material 5 is positioned by the separating portion 29*c* in a state in which it is spaced apart upward from the outer surface 132 at the above-described interval W1. Further, since the positioning portion 29*b* is formed to be shorter than the length of the exterior wall material 5 in the thickness direction, the separating portion 29*c* is located on the interior side with respect to the outer surface 5*a* of the exterior wall material 5 between the outer surface 132 and the lower end face of the exterior wall material 5.

Then, for example, a plurality of nails 41 are driven into the exterior wall material 5 that has been positioned in the above-described manner from the outer surface 5*a* side of the exterior wall material 5, with a resin spacer member 39 interposed between the back surface 5*b* of the exterior wall material 5 and the horizontal furring strip 15*b*, and thus, the exterior wall material 5 is fixed to the horizontal furring strip 15*b* together with the spacer member 39. At this time, each of the nails 41 is driven into the exterior wall material 5 at a position spaced farther away from the outer surface 132 than the end portion of the first waterproofing member 7. Consequently, in this exterior wall structure, the first waterproofing member 7 is prevented from being damaged by the distal ends of the nails 41 when the exterior wall material 5 is fixed to the horizontal furring strip 15*b*. Note that the spacer member 39 is not necessarily formed of resin, and is formed of metal or wood, for example. In addition, the thickness of the spacer member 39 is adjustable as appropriate.

As a result of the lower end face of the exterior wall material 5 coming into abutment with the positioning portion 29*b*, the first seal portion 31 comes into abutment with the back surface 5*b* of the exterior wall material 5 while being compressed and deformed between the exterior wall material 5 and the fixing portion 29*a* of the first waterproofing member 7. Thus, the exterior wall material 5 is mounted to the building 1 above the sash body 3*a*. As a result of the exterior wall material 5 being mounted to the building 1 in this way, the fixing portion 29*a* is located between the exterior wall material 5 and the horizontal furring strip 15*b*. Accordingly, the fixing portion 29*a* is concealed from the exterior side by the exterior wall material 5. Further, the provision of the spacer member 39 between the back surface 5*b* of the exterior wall material 5 and the horizontal furring strip 15*b* allows the exterior wall material 5 and the horizontal furring strip 15*b* to be fixed in a state in which they are spaced apart from each other by an amount corresponding to the thickness of the spacer member 39. Specifically, in this exterior wall structure, the thickness of the spacer member 39 is set to about 5 mm, for example. Note that the number of the nails 41 required to fix the exterior wall material 5 to the building 1 can be changed as appropriate. In place of the nails 41, a plurality of screws can be used to fix the exterior wall material 5 to the horizontal furring strip 15*b* together with the spacer member 39.

Likewise, for the exterior wall material 5 disposed below the sash body 3*a*, the upper end face of the exterior wall material 5 is brought into abutment with the positioning portion 29*b* of the second waterproofing member 8. Consequently, the exterior wall material 5 is positioned below the sash body 3*a* in a state in which it is spaced apart from the outer surface 132 of the sash body 3*a* at the above-described interval W1. By fixing the exterior wall material 5 to the horizontal furring strip 15*b* by means of the nails 41 in this state, the exterior wall material 5 is mounted to the building 1 below the sash body 3*a*.

For the exterior wall material 5 disposed on the right side of the sash body 3*a*, the left end face of the exterior wall material 5 is brought into abutment with the positioning portion 29*b* of the third waterproofing member 9. Consequently, the exterior wall material 5 is positioned on the right side of the sash body 3*a* in a state in which it is spaced apart from the outer surface 132 of the sash body 3*a* at the above-described interval W1. For the exterior wall material 5 disposed on the left side of the sash body 3*a*, the right end face of the exterior wall material 5 is brought into abutment with the positioning portion 29*b* of the fourth waterproofing member 10. Consequently, the exterior wall material 5 is positioned on the left side of the sash body 3*a* in a state in which it is spaced apart from the outer surface 132 of the sash body 3*a* at the above-described interval W1. Note that the exterior wall materials 5 that are disposed on the right side and the left side, respectively, of the sash body 3*a* are mounted to the building 1 by means of known joint fittings (not shown). Consequently, in the building 1, the exterior wall materials 5 are mounted around the sash body 3*a* in a state in which they are spaced apart from the sash body 3*a* at the interval W1, thus completing the exterior wall material mounting step.

Figure 8:
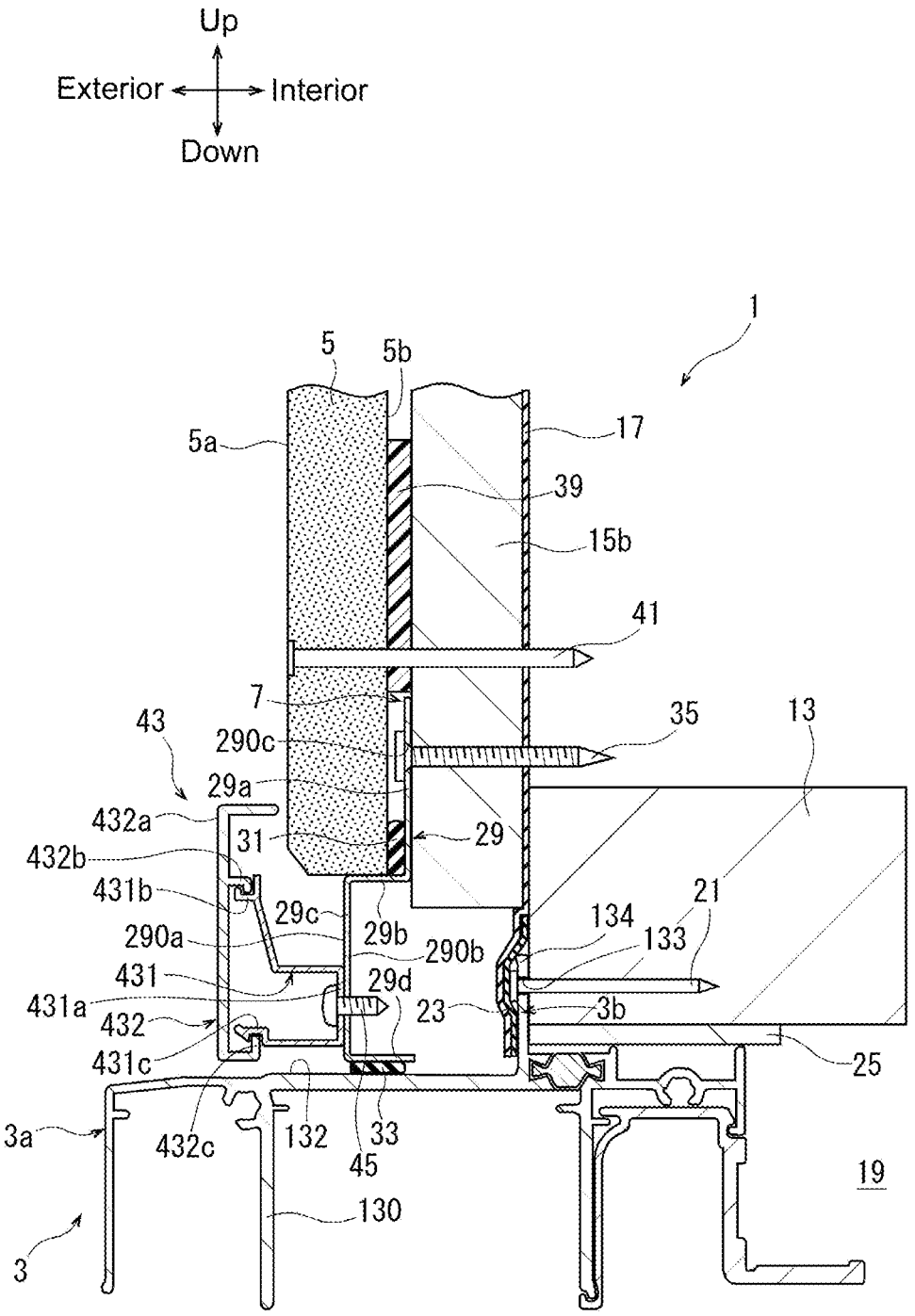
FIG. 8 is an enlarged cross-sectional view of a principal part of the exterior wall structure according to an embodiment, taken along the line B-B in FIG. 1.

After completion of the exterior wall material mounting step, a facing member mounting step is performed in which a facing member 43 is mounted around the window sash 3 as shown in FIG. 1. As shown in FIG. 8, the facing member 43 includes base members 431 and top members 432. The base members 431 and the top members 432 are disposed above and below, and on the left and right sides of the sash body 3*a*. Accordingly, the length, in the longitudinal direction, of each of the base members 431 and the top members 432 that are disposed on the upper and lower sides of the sash body 3*a* is defined according to the length of the sash body 3*a* in the left-right direction. On the other hand, the length in the longitudinal direction of each of the base members 431 and the top members 432 that are disposed on the left and right sides of the sash body 3*a* is defined according to the length of the sash body 3*a* in the up-down direction. In the following, the components and the mounting procedure will be described based on the base member 431 and the top member 432 provided above the sash body 3*a*.

A fixing portion 431*a*, as well as a first engaging portion 431*b* and a second engaging portion 431*c* are formed in the base member 431. A facing 432*a* is formed on the top member 432. Additionally, a first engaged portion 432*b* and a second engaged portion 432*c* are formed on the back surface side of the facing 432*a* of the top member 432.

The fixing portion 431*a* of the base member 431 is mounted to the separating portion 29*c* of the first waterproofing member 7 by means of a second mounting screw 45. Consequently, the base member 431 is disposed between the outer surface 132 of the sash body 3*a* and the lower end face of the exterior wall material 5 at a position located on the exterior face 290*a* side of the separating portion 29*c*. Note that the length of the second mounting screw 45 is adjusted such that the distal end does not come into contact with the waterproof tape 23 or the flange 3*b* when the fixing portion 431*a* is mounted to the separating portion 29*c*.

The top member 432 is assembled to the base member 431 by causing the first and second engaged portions 432*b* and 432*c* to be engaged with the first and second engaging portions 431*b* and 431*c*, respectively, of the base member 431. Thus, the top member 432 is disposed on the exterior side of the base member 431. Consequently, the facing 432*a* of the top member 432 covers the positioning portion 29*b*, the separating portion 29*c*, and the supporting portion 29*d* of the first waterproofing member 7, as well as a part of the exterior wall material 5.

The base member 431 and the top member 432 are also provided between the exterior wall material 5 and the sash body 3*a* below and to the right and left sides of the sash body 3*a* in the same manner, completing the facing member mounting step. Thus, the installation of the exterior wall structure is completed. Note that the facing member mounting step is not essential for this exterior wall structure, and is omissible.

The exterior wall structure that has been installed in the above-described manner includes the first to fourth waterproofing members 7 to 10. For each of the first to fourth waterproofing members 7 to 10, the second seal portion 33 is brought into abutment with the outer surface 132 of the sash body 3*a*. Consequently, with this exterior wall structure, it is possible to easily perform positioning at the time of fixing the first to fourth waterproofing members 7 to 10 to the vertical furring strip 15*a* and the horizontal furring strip 15*b*. Then, in a state in which the second seal portion 33 is brought into abutment with the outer surface 132, the fixing portion 29*a* is fixed to the vertical furring strip 15*a* and the horizontal furring strip 15*b* by means of the first mounting screws 35. At this time, with this exterior wall structure, the second seal portion 33 is attached to the outer surface 132 by using double-sided adhesive tape. Consequently, to fix the first to fourth waterproofing members 7 to 10 to the vertical furring strip 15*a* and the horizontal furring strip 15*b* by means of the first mounting screws 35, it is possible to suitably prevent the first to fourth waterproofing members 7 to 10 from being displaced from the vertical furring strip 15*a* and the horizontal furring strip 15*b*. Accordingly, with this exterior wall structure, it is possible to easily fix the first to fourth waterproofing members 7 to 10 to the vertical furring strips 15*a* and the horizontal furring strips 15*b*.

Also, in this exterior wall structure, in a state in which the first to fourth waterproofing members 7 to 10 are fixed to the vertical furring strip 15*a* and the horizontal furring strip 15*b*, the end faces of the exterior wall materials 5 are brought into abutment with the positioning portions 29*b* of the first to fourth waterproofing members 7 to 10. Consequently, with this exterior wall structure, the outer surface 132 of the sash body 3*a* and the exterior wall materials 5 are uniformly positioned at the interval W1 in the up-down direction of FIG. 8 by the separating portions 29*c* of the first to fourth waterproofing members 7 to 10, and the exterior wall materials 5 are positioned relative to the outer surface of the building 1 in the exterior-interior direction by the positioning portions 29*b*. Accordingly, with this exterior wall structure, it is possible to mount the exterior wall materials 5 to the building 1 while positioning the exterior wall materials 5 easily and accurately, without requiring a skilled technician.

Also, in this exterior wall structure, the first seal portion 31 is provided on the fixing portion 29*a* of each of the first to fourth waterproofing members 7 to 10, and the second seal portion 33 is provided on each of the supporting portions 29*d*. Consequently, by simply fixing the first to fourth waterproofing members 7 to 10 to the vertical furring strips 15*a* and the horizontal furring strips 15*b* and bringing the end faces of the exterior wall materials 5 into abutment with the positioning portions 29*b* in the above-described manner, it is possible, using the first seal portions 31, to prevent the entry of water into the interior side from between the first to fourth waterproofing members 7 to 10 and the exterior wall materials 5. Further, it is possible, using the second seal portions 33, to prevent the entry of water into the interior side from between the first to fourth waterproofing members 7 to 10 and the outer surface 132 of the sash body 3*a*. Accordingly, although filling with the caulking compound 37 is supplementally performed to waterproof the building 1, it is possible to reduce the number of locations filled with the caulking compound 37. Consequently, with this exterior wall structure, the waterproofing of the building 1 is easily achieved. Note that the caulking compound filling step is omissible for this exterior wall structure as described above. In this case, it is not necessary to fill with the caulking compound 37 to waterproof the building 1, making it possible to waterproof the building 1 more easily.

Accordingly, with the exterior wall structure according to the embodiment, it is possible to accurately position the exterior wall materials 5, ensure the waterproofness of the building 1 to which the window sash 3 and the exterior wall materials 5 are mounted, and achieve easy installation.

In particular, with this exterior wall structure, the interval from the outer surface 132 of the sash body 3*a* to the positioning portions 29*b*, or in other words, the interval between the outer surface 132 of the sash body 3*a* and the end faces of the exterior wall materials 5 is determined by the length of the separating portions 29*c* of the first to fourth waterproofing members 7 to 10 in the width direction. Accordingly, the interval between the outer surface 132 of the sash body 3*a* and the exterior wall materials 5 is easily set to a length other than the above-described interval W1, for example, by changing the length of the separating portions 29*c* in the width direction according to the shape of the facing member 43 or the design of the building 1.

Further, in this exterior wall structure, the waterproof tape 23 or the flange 3*b* is prevented from the damages caused by contacting with the distal ends of the first and second mounting screws 35 and 45 and the nails 41 when the first to fourth waterproofing members 7 to 10, the exterior wall materials 5 and the base members 431 of the facing member 43 are mounted. Accordingly, with this exterior wall structure, it is not necessary to perform an operation such as additionally filling with the caulking compound 37 to prevent the entry of water into the interior side from the gap in the waterproof tape 23 or the flange 3*b* that has been damaged by the first mounting screws 35 or the like. Therefore, it is possible to easily waterproof the building 1.

Furthermore, with this exterior wall structure, the facing member 43 is provided around the window sash 3, and therefore, the separating portions 29*c* of the first to fourth waterproofing members 7 to 10 and the like are concealed from the exterior side of the building 1 by the facings 432*a* of the top members 432.

In this exterior wall structure, the separating portions 29*c* are located on the interior side with respect to the outer surfaces 5*a* of the exterior wall materials 5 when the exterior wall materials 5 are mounted to the building 1. Accordingly, the separating portions 29*c* do not protrude to the exterior side with respect to the outer surfaces 5*a* of the exterior wall materials 5 between the outer surface 132 of the sash body 3*a* and the end faces of the exterior wall materials 5. Consequently, the facing member 43 does not unnaturally protrude to the exterior side when the facing member 43 is mounted, making it possible to enhance the aesthetic appearance of the building 1. Since the separating portions 29*c* do not protrude to the exterior side with respect to the outer surfaces 5*a* of the exterior wall materials 5, the separating portions 29*c* are less noticeable between the outer surface 132 of the sash body 3*a* and the end faces of the exterior wall materials 5 when the building 1 is viewed from the exterior side even if the facing member mounting step is omitted and the facing member 43 is not provided. Consequently, with this exterior wall structure, the aesthetic appearance of the building 1 is enhanced even if the facing member 43 is not provided.

Furthermore, the separating portion 29*c* is formed flat, and it is therefore possible to easily form the separating portion 29*c*, as well as the fixing portion 29*a*, the positioning portion 29*b*, and the supporting portion 29*d* on the waterstop body 29 by press working a metal plate. This makes it possible to reduce the manufacturing cost for the first to fourth waterproofing members 7 to 10 and hence the cost required to install the exterior wall structure.

Since the separating portion 29*c* is flat, the installation of the base member 431 is easier. In addition, it is possible to enhance the aesthetic appearance of the building 1 even if the facing member mounting step is omitted as described above.

Furthermore, in this exterior wall structure, as a result of the exterior wall materials 5 being mounted to the building 1, the first seal portions 31 are located between the back surfaces 5*b* of the exterior wall materials 5 and the fixing portions 29*a* of the first to fourth waterproofing members 7 to 10. Also, the supporting portion 29*d* is formed by being bent from the end portion of the other end side of the separating portion 29*c* toward the interior side. Thereby, with this exterior wall structure, the supporting portions 29*d* and the second seal portions 33 are not exposed on the exterior side when the first to fourth waterproofing members 7 to 10 are mounted around the sash body 3*a*. Accordingly, with the exterior wall structure, it is possible to enhance the aesthetic appearance of the building 1, and suitably prevent the first and second seal portions 31 and 33 from being degraded by ultraviolet radiation.

Although the present invention has been described above by way of an embodiment, the present invention is by no means limited to the above-described embodiment. Needless to say, modifications can be made as appropriate without departing from the scope and spirit of the invention.

For example, in the present embodiment, the exterior wall material and the waterproofing member are mounted by using the furring strip as the wall backing member. Alternatively, the exterior wall material and the waterproofing member are directly mounted to the frame member in an installation method that does not use a wall backing member.

For example, depending on the position at which the window sash 3 is provided in the building 1, the first waterproofing member 7 or the like is mounted in only one location such as above the sash body 3*a*. The exterior wall structure according to the embodiment is also used, for example, around a door of the building 1. In this case, a door is an example of the opening member according to the present invention. Furthermore, the exterior wall structure according to the embodiment is also used for a building other than the wooden building 1.

In the exterior wall structure according to the embodiment, the length of the waterstop body 29 of the first waterproofing member 7 in the longitudinal direction is defined according to the length of the sash body 3*a* in the left-right direction to be one long first waterproofing member 7. However, the present invention is not limited thereto, and the length of the waterstop body 29 in the longitudinal direction is alternatively formed to be shorter than the length of the sash body 3*a* in the left-right direction, and a plurality of short first waterproofing members 7 are disposed above the sash body 3*a*. The same applies to the second to fourth waterproofing members 8 to 10.

Furthermore, the waterstop body 29 is alternatively designed such that the length by which the positioning portion 29*b* extends to the exterior side is equivalent to the length of the exterior wall material 5 in the thickness direction, or longer than the length of the exterior wall material 5 in the thickness direction. In this case, depending on the length by which the positioning portion 29*b* extends to the exterior side, the exterior face 290*a* of the separating portion 29*c* and the outer surface 5*a* of each of the exterior wall materials 5 constitute substantially identical continuous surfaces, or the separating portion 29*c* protrudes to the exterior side by a certain amount with respect to the outer surface 5*a* of each of the exterior wall materials 5.

What is claimed is:

1. A waterproofing member for waterproofing a building, comprising a frame member defining an opening that provides communication between an exterior side and an interior side, an exterior wall material configured to be mounted on the exterior side of the frame member, a wall backing member that is mounted to the frame member and is located between the frame member and the exterior wall material, and an opening member including an opening member body disposed in the opening, the waterproofing member comprising:

a fixing portion configured to be fixed to at least one of the wall backing member and the frame member at a time of installation when the waterproofing member is installed between the wall backing member and the exterior wall material;

a positioning portion joined to the fixing portion, and extending toward the exterior side so that an upper surface of the positioning portion faces an end face of the exterior wall material at the time of the installation;

a separating portion joined to the positioning portion, and extending toward the opening member body side so as to be located between the opening member body and the exterior wall material at the time of the installation;

a supporting portion joined to the separating portion, and facing the opening member body at the time of the installation;

a first seal portion disposed between the fixing portion and the positioning portion, so that the first seal portion contacts both a front surface of the fixing portion and the upper surface of the positioning portion and coming into abutment with a back surface of the exterior wall material at the time of the installation; and a second seal portion provided on the supporting portion, and coming into abutment with the opening member body at the time of the installation, wherein the first seal portion is fixed only to the front surface of the fixing portion so that the first seal portion is compressed and deformed between the back surface of the exterior wall material and the front surface of the fixing portion, and the compressed and deformed first seal portion comes into contacts with the back surface of the exterior wall material, the upper surface of the positioning portion and the front surface of the fixing portion to form a waterproof structure.

2. The waterproofing member according to claim 1, wherein the separating portion is located on the interior side with respect to an outer surface of the exterior wall material at the time of the installation.

3. The waterproofing member according to claim 1, wherein the opening member body includes a flange extending in a substantially orthogonal direction from an outer surface of the opening member body, and the separating portion has a length greater than a length of the flange from the outer surface of the opening member body to an end portion of the flange.

4. The waterproofing member according to claim 3, wherein the fixing portion is mounted to at least one of the wall backing member and the frame member at a position farther away from the outer surface of the opening member body than the end portion of the flange at the time of the installation.

5. The waterproofing member according to claim 4, wherein the fixing portion is mounted to at least one of the wall backing member and the frame member by a fastener at the time of the installation.

6. The waterproofing member according to claim 1, wherein the supporting portion extends toward the interior side at the time of the installation.

7. The waterproofing member according to claim 1, wherein the separating portion is formed flat.

8. A waterproofing member for waterproofing a building, comprising a frame member defining an opening that provides communication between an exterior side and an interior side, an exterior wall material configured to be mounted on the exterior side of the frame member, and an opening member including an opening member body disposed in the opening, the waterproofing member comprising:

a fixing portion configured to be fixed to the frame member at a time of installation when the waterproofing member is installed between the frame member and the exterior wall material;

a positioning portion joined to the fixing portion, and extending toward the exterior side so that an upper surface of the positioning portion faces an end face of the exterior wall material at the time of the installation;

a separating portion joined to the positioning portion, and extending toward the opening member body side so as to be located between the opening member body and the exterior wall material at the time of the installation;

a supporting portion joined to the separating portion, and facing the opening member body at the time of the installation;

a first seal portion disposed between the fixing portion and the positioning portion, so that the first seal portion contacts both a front surface of the fixing portion and the upper surface of the positioning portion, and coming into abutment with a back surface of the exterior wall material at the time of the installation; and a second seal portion provided on the supporting portion, and coming into abutment with the opening member body at the time of the installation, wherein the first seal portion is fixed only to the front surface of the fixing portion so that the first seal portion is compressed and deformed between the back surface of the exterior wall material and the front surface of the fixing portion, and the compressed and deformed first seal portion comes into contacts with the back surface of the exterior wall material, the upper surface of the positioning portion and the front surface of the fixing portion to form a waterproof structure.

9. The waterproofing member according to claim 8, wherein the building includes a wall backing member that is mounted to the frame member and is located between the frame member and the exterior wall material, and the fixing portion is fixed to the frame member via the wall backing member at a time of installation when the waterproofing member is installed between the frame member and the exterior wall material.

10. An exterior wall structure for waterproofing a building by using a waterproofing member, comprising:

i) the building comprising:

a frame member defining an opening that provides communication between an exterior side and an interior side;

an exterior wall material mounted on the exterior side of the frame member;

a wall backing member that is mounted to the frame member, and is located between the frame member and the exterior wall material; and an opening member including an opening member body disposed in the opening, and ii) the waterproofing member installed between the wall backing member and the exterior wall material of the building, wherein the water proofing member comprises:

a fixing portion fixed to at least one of the wall backing member and the frame member;

a positioning portion joined to the fixing portion, and extending toward the exterior side so that an end face of the exterior wall material abuts an upper surface of the positioning portion;

a separating portion that is joined to the positioning portion, extends toward the opening member body side, and is located between the opening member body and the exterior wall material;

a supporting portion joined to the separating portion, and facing the opening member body;

a first seal portion disposed between the fixing portion and the positioning portion so that the first seal portion contacts both a front surface of the fixing portion and the upper surface of the positioning portion, and coming into abutment with a back surface of the exterior wall material; and a second seal portion provided on the supporting portion, so that the supporting portion abuts the opening member body via the second seal portion, wherein the first seal portion is fixed only to the front surface of the fixing portion so that the first seal portion is compressed and deformed between the back surface of the exterior wall material and the front surface of the fixing portion, and the compressed and deformed first seal portion contacts with the back surface of the exterior wall material, the upper surface of the positioning portion and the front surface of the fixing portion to form a waterproof structure.

11. The exterior wall structure according to claim 10, wherein the separating portion is located on the interior side with respect to an outer surface of the exterior wall material.

12. The exterior wall structure according to claim 11, wherein the opening member body includes a flange extending in a substantially orthogonal direction from an outer surface of the opening member body, and the separating portion has a length greater than a length of the flange from the outer surface of the opening member body to an end portion of the flange.

13. The exterior wall structure according to claim 12, wherein the fixing portion is mounted to at least one of the wall backing member and the frame member at a position farther away from the outer surface of the opening member body than the end portion of the flange.

14. The exterior wall structure according to claim 13, wherein the fixing portion is mounted to at least one of the wall backing member and the frame member by a fastener.

* * * * *